US006120178A

United States Patent [19]

Meusburger et al.

[11] Patent Number: 6,120,178

[45] Date of Patent: Sep. 19, 2000

[54] METHOD FOR ADJUSTING THE RATE OF A HOROLOGICAL MODULE BY MEANS OF FUSES ABLE TO BE DESTROYED BY LASER

[75] Inventors: Guenther Meusburger, Vinelz; Nicolas Jeannet, Chambrelien; Rudolf Bugmann, Erlach, all of Switzerland

[73] Assignee: EM Microelectronic-Marin SA, Marin, Switzerland

[21] Appl. No.: 09/434,200

[22] Filed: Nov. 4, 1999

[30] Foreign Application Priority Data

Nov. 5, 1998 [CH] Switzerland ..... 2226/98

[51] Int. Cl.[7] ..... G04B 18/00

[52] U.S. Cl. ..... 368/201

[58] Field of Search ..... 368/85–87, 200–202

[56] References Cited

U.S. PATENT DOCUMENTS

| | | | |
|---|---|---|---|
| 4,199,726 | 4/1980 | Bukeske et al. | 368/200 |
| 4,254,494 | 3/1981 | Meda | 368/201 |
| 4,345,320 | 8/1982 | Berney . | |

FOREIGN PATENT DOCUMENTS

| | | |
|---|---|---|
| 595 629 | 5/1994 | European Pat. Off. . |
| 645 689 | 3/1995 | European Pat. Off. . |
| 2 349 508 | 4/1974 | Germany . |
| 98 34165 | 8/1998 | WIPO . |

OTHER PUBLICATIONS

Patent Abstracts of Japan, vol. 008, No. 271 (P–320), Dec. 12, 1984 & JP 59 138981 A (Suwa Seikosha KK), Aug. 9, 1984.

Patent Abstracts of Japan, vol. 007, No. 140 (E–182), Jun. 18, 1983 & JP 58 054705 A (Citizen Tokei KK), Mar. 31, 1983.

*Primary Examiner*—Vit Miska

*Attorney, Agent, or Firm*—Sughrue, Mion Zinn, Macpeak & Seas, PLLC

[57] ABSTRACT

A method for adjusting the rate of a horological module, said horological module including a printed circuit (1) on which are mounted in particular a quartz (10) and an integrated circuit (20) including an oscillator (21) driven by the quartz (10), a frequency divider circuit (22) with several stages (22.1 to 22.15), an adjustment circuit (23) allowing the introduction of a correction factor of the division ratio of said frequency divider circuit (22), and a memory circuit (24) containing data (N) representing said correction factor. The adjustment method according to the present invention uses a laser device to allow said data (N) representing the correction factor to be coded by the selective destruction of fuses (F1, F2; F.1 to F.6; F.1* to F.6*) forming memory elements of said memory circuit (24).

4 Claims, 3 Drawing Sheets

Figure 1:
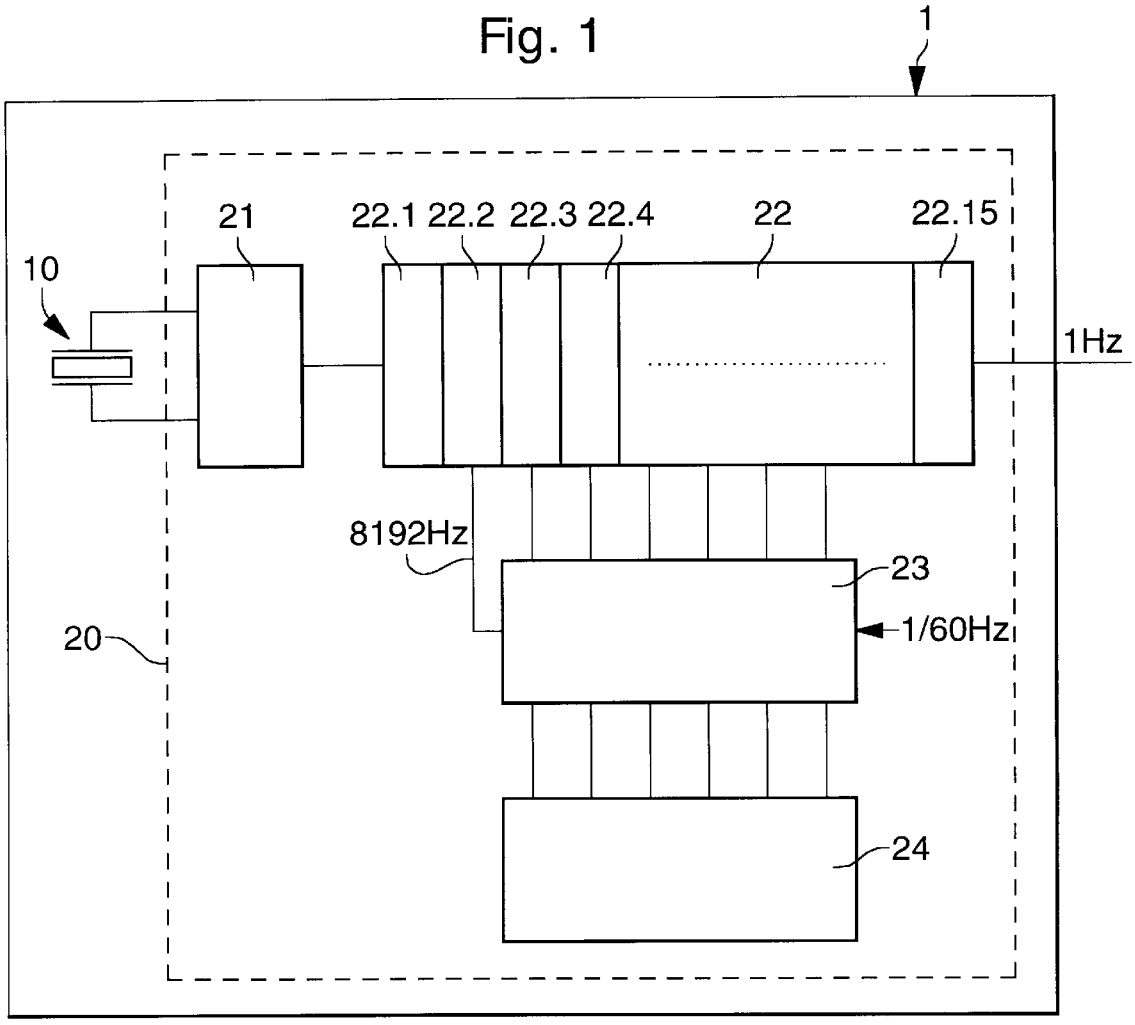

METHOD FOR ADJUSTING THE RATE OF A HOROLOGICAL MODULE BY MEANS OF FUSES ABLE TO BE DESTROYED BY LASER

The present invention relates to a method allowing the rate of a horological module to be adjusted, said horological module including in particular a quartz and an integrated circuit including an oscillator driven by the quartz, a frequency divider circuit with several stages, an adjustment circuit allowing the introduction of a correction factor of the division ratio of said frequency divider circuit and a memory circuit containing data representative of said correction factor.

<<Method for adjusting the rate>> means a method consisting of introducing a correction factor of the division ratio of the frequency divider circuit, so that the frequency of the pulses supplied to the output thereof is corrected so as to fall within a predetermined range.

<<Module>> further means a semi-finished or intermediate system, ready to be mounted in the end product. In particular, in the following description, <<horological module>> means a printed circuit including various electronic components, in particular the quartz and the aforementioned integrated circuit.

Adjusting the frequency of the oscillator, in particular a quartz oscillator is a particularly complicated and difficult operation. As is explained in the preamble of Swiss Patent No. 534 913, this adjustment is performed via a first rough adjustment step by mechanical precision operations on the quartz, then a second fine adjustment step on the encapsulated quartz, and finally a last adjustment and ageing compensation step by an adjustment or trimmer system.

These steps have the drawback of being difficult and complex, which greatly affects the cost of the timepiece. Moreover, the frequency stability of the quartz substantially deteriorates. Consequently, Swiss Patent No. 534 913 propose a satisfactory and inexpensive solution, by acting directly on the division ratio of the frequency divider circuit by introducing a correction factor, which has the effect of improving the stability of the quartz and removing the need to use a trimmer. For this purpose, the frequency divider circuit proposed in Swiss Patent No. 534 913 has auxiliary electric inputs whose logic state determines the division ratio of the frequency divider and a memory circuit, connected to these auxiliary inputs, to store in coded form data representative of the correction factor of the division ratio of the frequency divider circuit.

The system which has just been mentioned operates via the periodic inhibition or omission of a determined number of pulses supplied by the oscillator. It will be mentioned that a system operating in an alternative manner by adding a determined number of pulses is further proposed in Swiss Patent No. 558 559.

Whichever system is chosen, the adjustment circuit is typically connected to a memory circuit containing the data representing the correction factor of the division ratio. This data is preferably stored in a non volatile manner, so that the data is not lost during a battery change or an interruption of the power supply.

Various embodiments of the memory circuit are known in the prior art. In particular, solutions using re-programmable non volatile memories (EPROMs/EEPROMs) or additional contact pads are generally adopted.

The use of an EPROM/EEPROM requires significant investment in terms of the surface area of the integrated circuit, since a memory of this type has not only to include a sufficient number of bits to code the data representing the correction factor, but also requires the implementation of a programming logic allowing the latter to be programmed and a voltage multiplier circuit in order to generate the high voltages necessary for such programming. This obviously leads to a substantial increase in the manufacturing cost of the integrated circuit due in particular to the additional steps necessary for integrating the EPROM/EEPROM and is reflected in the manufacturing cost of the horological module and the timepiece itself.

The use of additional contact pads also requires a significant investment in surface area (one contact pad per bit) as well as additional connecting paths on the printed circuit.

The implementation of such contact pads also leads to an increase in the manufacturing cost of the integrated circuit and the horological module.

It will be noted that the relative cost of the aforementioned solutions depends essentially on the surface area of the circuit, the number of bits and the additional manufacturing cost due to any integration of an EPROM/EEPROM.

It will further be mentioned that, whatever solution is used, when the surface area of the circuit becomes larger, the surface investment is proportionally low and becomes negligible for a circuit of several tens of $mm^2$.

On the other hand the relative cost linked to the additional manufacturing steps of an EPROM/EEPROM remains constant as a function of the surface area and thus constitutes a determining element for circuits of large size. In other words, the additional cost of the implementation of the EPROM/EEPROM bits is practically proportional to the surface area of the circuit, which is why the solution using additional contact pads is more economical for circuits of large size.

For circuits of small size (some $mm^2$) the choice is much more debatable. The investment in surface area becomes proportionally significant.

One EPROM/EEPROM bit requires less surface area than one additional contact pad, but generates however a fixed investment due in particular to the programming logic and the voltage multiplier. Thus, the higher the number of bits, the more economical in terms of surface area the EPROM/EEPROM solution compared to the solution using additional contact pads. Conversely, the manufacturing cost by surface unit remains proportionally higher.

In practice, for circuits of some $mm^2$, the surface area advantage of the EPROM/EEPROM solution balances the additional manufacturing costs and the two solutions are thus economically comparable.

By way of example, it will be noted that French Patent Application No. 2,238,280 discloses an integrated oscillator and the method for the digital frequency adjustment thereof including memory components which can be programmed from outside the integrated circuit. These components are diodes certain of which are short-circuited in order to permanently modify their state. Each component is connected to a terminal of the integrated circuit.

Swiss Patent No. 534 913, cited above, proposes using a memory circuit formed of a plurality of individual memory components, for example able to be altered electrically, each associated with a programming terminal of the integrated circuit.

Swiss Patent No. 621 036 also discloses another integrated system allowing the division ratio of a frequency divider circuit to be adjusted. This integrated system includes memory circuits including a diode in series with a memory component formed of a fuse formed of a particular metallisation of the integrated circuit which can be destroyed by passing a current of a certain level. Each memory component can be separately addressed by means of the diodes by applying a combination of particular voltages across the terminals of the integrated circuit.

It will be noted that the solutions proposed in the aforecited Patents necessarily require the use of existing and/or additional connection terminals of the integrated circuit so as to allow storage of the correction factor. Certain solutions sometimes further require the disconnection of certain components, in particular the power supply, when the memory is programmed which makes the programming operation sometimes long and complex.

An object of the present invention is thus to propose a method for adjusting the rate of a horological module which does not require complex implementation as regards the integrated circuit, so that the manufacturing cost thereof, and thus of the module itself, is not greatly affected.

Another object of the present invention is to propose a method for adjusting the rate of a horological module which is particularly suitable for the mass or automated production of horological modules, i.e. a simple and quick adjustment method.

The present invention therefore concerns a method for adjusting the rate of a horological module, said horological module including a printed circuit on which are mounted in particular a quartz and an integrated circuit including:

an oscillator driven by said quartz, a frequency divider circuit, an adjustment circuit allowing a correction factor of the rate of said horological module to be introduced into said frequency divider circuit, and a memory circuit containing data representing said correction factor, this method including the following steps:

a) measuring the rate of said horological module;

b) calculating said correction factor of the rate of said horological module; and c) storing said data representing said correction factor in said memory circuit, this method being characterised in that the memory circuit includes memory elements formed of fuses which can be destroyed by laser and in that said integrated circuit is mounted beforehand, prior to measuring step a), on said printed circuit without application of any protective resin, storage step c) including the following steps:

c1) aligning the module under a laser device;

c2) destroying, by means of said laser device, said fuses necessary for coding said data representing the correction factor of the rate of the horological module;

this storage step c) being further followed by the following step:

d) depositing said protective resin over said integrated circuit.

One advantage of the present invention lies in the fact that storage of the data representing the correction factor is performed simply and especially quickly, and is thus particularly suitable for the mass production of such modules. The rapidity and simplicity of the adjustment method according to the present invention thus assures a substantial reduction in the manufacturing costs.

It will further be noted that the present invention also has the advantage of allowing adjustment of the rate of a horological module, i.e. a finished or intermediate assembly including electronic components other than the quartz, oscillator, frequency divider circuit, adjustment circuit of the division ratio or memory circuit. In this way, the adjustment can be effected taking into consideration the influences of all the electronic components of the module.

Another advantage of the present invention lies in the fact that the cost of the integrated circuit and the horological module itself is not substantially affected. In particular, the use of memory elements formed of fuses which can be destroyed by laser does not require complex and expensive implementation as regards the integrated circuit.

Figure 2A:
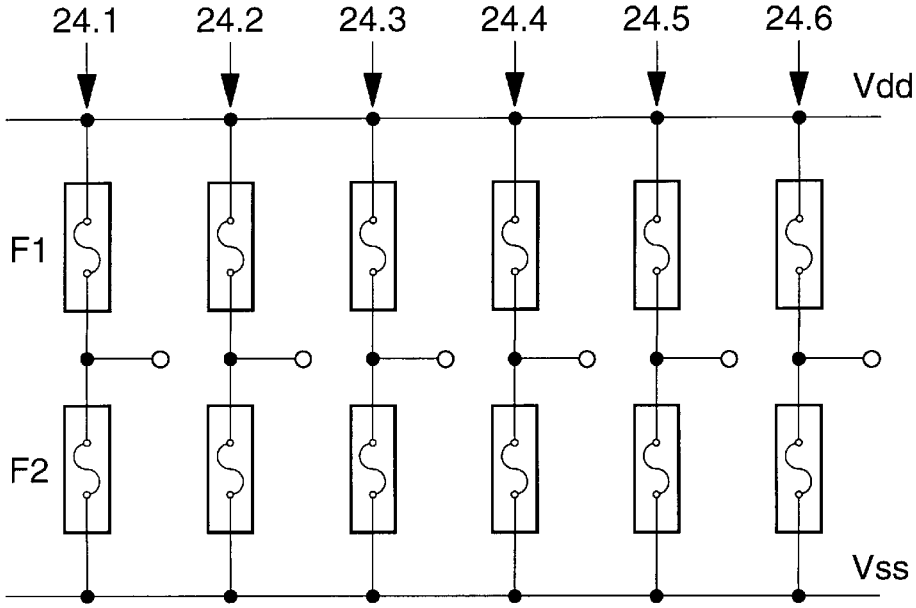
Figure 2B:
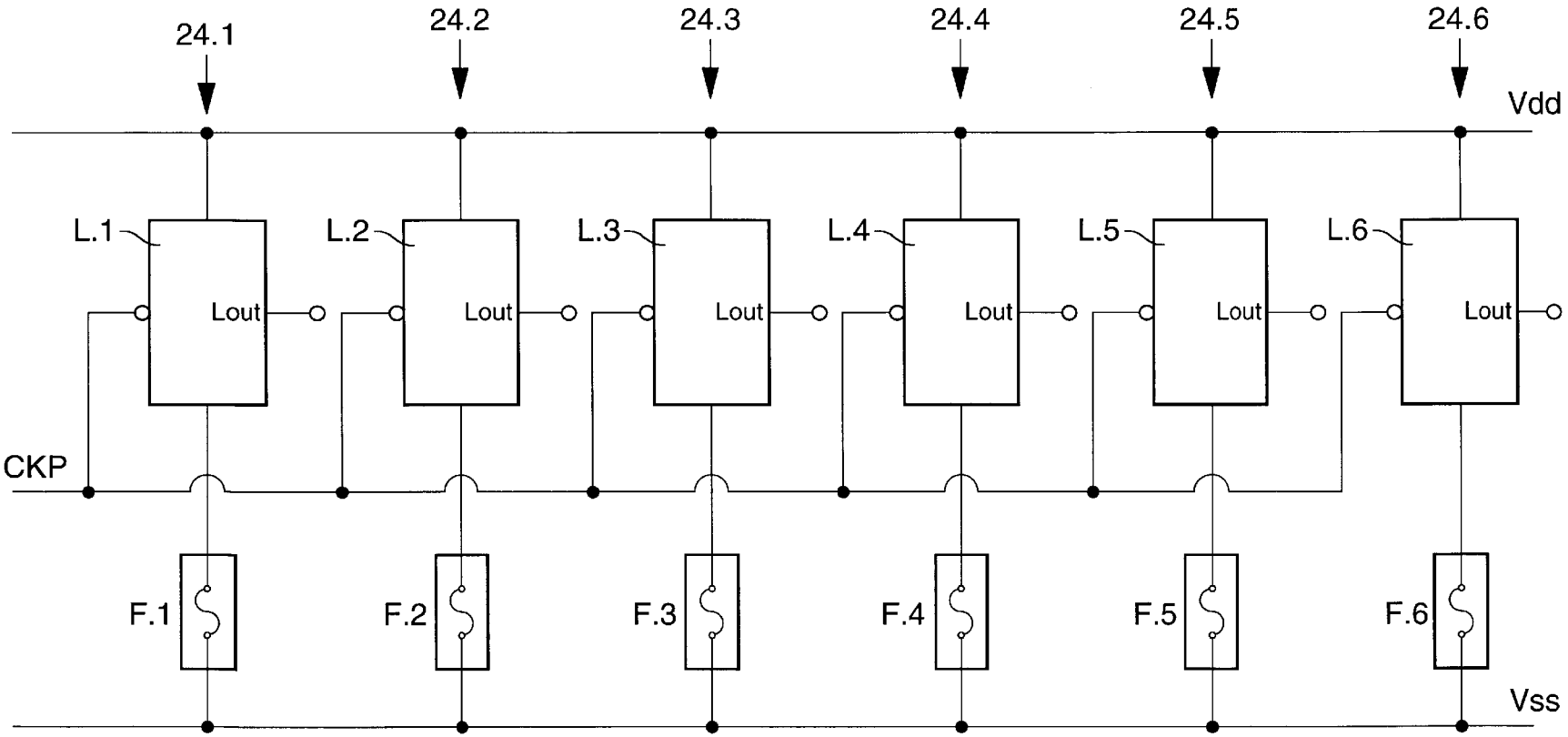
Figure 2C:
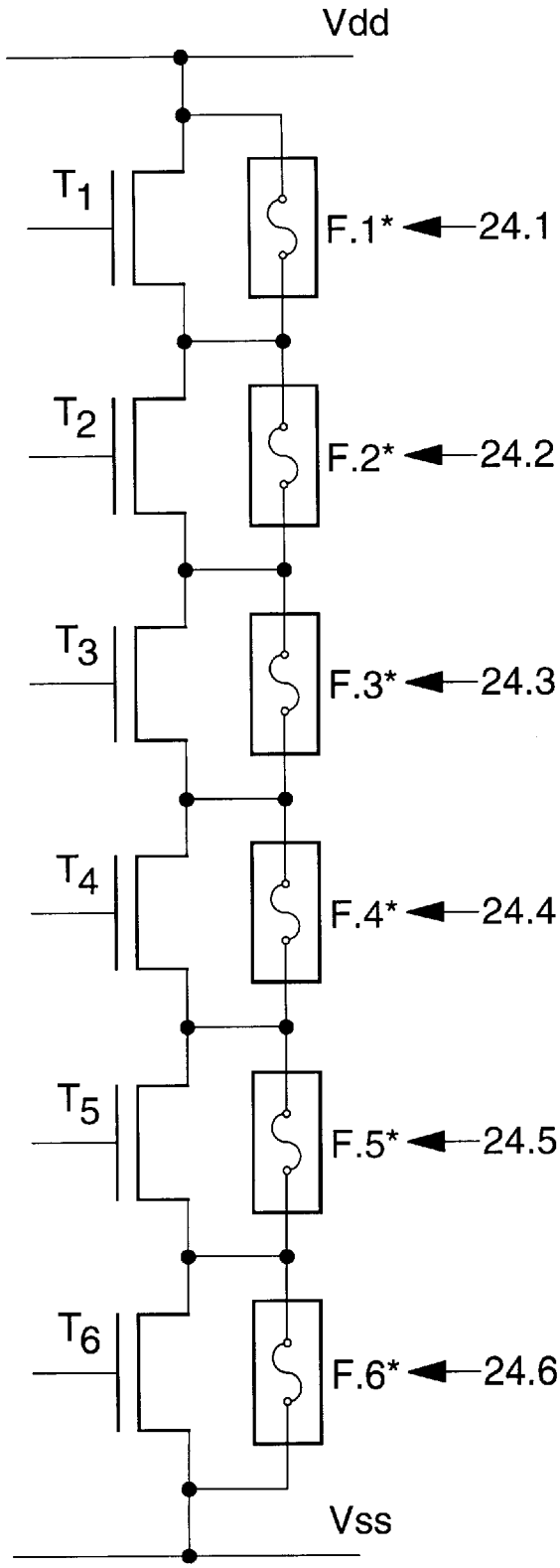

Other features and advantages of the present invention will appear upon reading the following description, which is made with reference to the annexed drawings, given solely by way of example, and in which:

FIG. 1 shows a block diagram of a horological module including a quartz, an oscillator, a frequency divider circuit, an adjustment circuit and a memory circuit;

FIGS. 2*a* to 2*c* show various implementation examples of a 6 bit memory circuit including memory elements formed of fuses able to be destroyed by laser.

FIG. 1 is a schematic diagram of a horological module including a printed circuit 1 including in particular a quartz 10 and an integrated circuit 20. This integrated circuit 20 includes an oscillator 21 driven by quartz 10 so as to supply typically pulses at a frequency of 32768 Hz. This frequency is divided several times by a frequency divider circuit 22 so as to supply at the output thereof pulses at a frequency of 1 Hz and thus to allow a time related data item to be formed and displayed.

In the example illustrated in FIG. 1, frequency divider circuit 22 thus includes a total number of 15 binary division stages 22.1 to 22.15. The first two stages 22.1 and 22.2 allow in particular a signal to be supplied at a frequency of 8192 Hz which is used to allow the correction of the division ratio of frequency divider circuit 22.

An adjustment circuit 23 thus allows a correction factor of the division ratio to be introduced into frequency divider circuit 22. A memory circuit 24 thus contains a data item, generally in the form of a binary number N, representing the correction factor of the division ratio for frequency divider circuit 22.

It will be recalled that various techniques for adjusting the division ratio are known in the prior art. One of these, disclosed in Swiss Patent No. 534 913, called the inhibition technique, consists in omitting a number N of pulses during a determined period. The description which follows is based on such a technique, but it will of course be understood that the invention can be extended by analogy to other known techniques such as that consisting in adding a complementary number of pulses.

The adjustment method essentially consists in correcting the frequency drift existing between the frequency of oscillator 21 and the frequency supplied by a standard oscillator, this frequency drift being measured in ppm (parts per million). This frequency drift can be corrected, in accordance with the inhibition technique, by omitting a number N of pulses of period $T_i$, during a determined period $T_h$, called the inhibition period.

In the example of FIG. 1, inhibition occurs at the output of the first two division stages 22.1 and 22.2 of frequency divider circuit 22, i.e. from pulses supplied at a frequency of 8192 Hz ($T_i$=122 $\mu$s). By performing the inhibition in a periodic manner, for example every 60 seconds, the resolution of the system thus reaches 2.03 ppm.

With such a resolution and in order to obtain a sufficient correction range, for example of the order of 100 ppm, it will be noted consequently that the number N will require at least 6 memory bits. In practice, according to the application, this number may require between 4 and 9 bits.

According to the present invention, memory circuit 24 includes memory elements formed of fuses able to be destroyed by laser. FIG. 2*a* illustrates a first example of a 6 bit memory circuit including 6 memory elements 24.1 to 24.6 connected in parallel and each including a pair of fuses F1 and F2 able to be destroyed by laser. Fuses F1 and F2 of each memory element are connected in series between a <<high>> potential line Vdd and a <<low>> potential line Vss. Destruction of one of fuses F1 or F2 thus allows the intermediate point situated between fuses F1, F2 to be set at high potential Vdd or low potential Vss respectively. Coding a data item (number N) representing the correction factor of the division ratio of the frequency divider circuit 22 can thus easily be achieved by means of a laser by destroying one or the other of fuses F1 or F2.

FIG. 2*b* shows a second example of a 6 bit memory circuit including 6 memory elements 24.1 to 24.6 each including a fuse F.1 to F.6 able to be destroyed by laser associated with an interface circuit L.1 to L.6. Interface circuit L and fuse F are connected in series between a <<high>> potential line Vdd and a <<low>> potential line Vss. The interface circuit can be formed by those skilled in the art in a conventional manner in the form of a latch allowing the input state defined by the fuse to be copied. For this purpose, the latch further includes a loading input CKP upon whose activation an output Lout of the latch takes the corresponding state defined by the state of the associated fuse. In this case, output Lout of the latch takes the <<high>> state if the fuse is destroyed and the <<low>> state if the fuse is intact.

FIG. 2*c* shows another example of a 6 bit memory circuit. This solution integrates in part an inhibition logic of frequency divider circuit 22. The six memory elements 24.1 to 24.6, connected in series, each include a fuse F.1* to F.6* connected in parallel to a transistor T1 to T6. Each transistor is controlled respectively by the clock signals of six division stages of frequency divider circuit 22 on which inhibition is effected in accordance with the description hereinbefore.

If the fuse is intact, the transistor is short-circuited and the clock signal at its input has no effect. If the fuse is destroyed, the transistor can then produce an effect on the inhibition of frequency divider circuit 22. By the selective destruction of certain fuses among fuses F.1* to F.6*, it is thus possible to adjust the inhibition ratio of frequency divider circuit 22.

It will be noted that the use of fuses able to be destroyed by laser constitutes a substantial advantage with respect to the use of fuses destroyed by a current. Indeed, the fuses can be selectively destroyed directly on the integrated circuit by means of a laser device. This process thus does not require the use of any particular terminals and addressing means. The use of fuses able to be destroyed by laser is further much more economical than all the known solutions since it does not involve any significant investment in terms of surface area as regards the integrated circuit.

No additional manufacturing cost is generated as regards the integrated circuit, since such fuses can easily be made simultaneously during one of the manufacturing steps of integrated circuit 20. As already mentioned, integration of an EPROM/EEPROM or additional contact pads would involve additional manufacturing cost.

The use of fuses able to be destroyed by laser does not however directly appear the most suitable solution for those skilled in the art. Indeed, those skilled in the art are confronted with various constraints and difficulties connected to the use of fuses able to be destroyed by laser. In the following description, one will attempt to describe briefly these constraints and difficulties.

A first constraint lies in the fact that the use of a laser beam allowing the fuses to be selectively destroyed on the integrated circuit implies that this operation has to be effected prior to the deposition of the protective resin thereon. One cannot envisage proceeding with the destruction of the fuses by means of the laser through the protective resin, which in this case would have to be transparent, since this would have the effect of completely annihilating the advantage of such a deposition, in particular the protection of the integrated circuit against ambient impurities and light.

Further, it will be noted that the subsequent deposition of this protective resin generates modifications in the electrical properties of the integrated circuit and thus the frequency properties thereof. It is thus necessary to compensate for this influence when the correction factor is calculated for the frequency divider circuit.

Another constraint lies in the fact that the lighting conditions also have a not negligible influence on the properties of the integrated circuit. The adjustment operation, in particular the measuring operation of the rate of the module, is thus preferably effected in well determined lighting conditions.

The adjustment method of the rate of the horological module according to the present invention requires a preliminary preparation phase before effecting the rate adjustment itself.

The preparation phase consists in implementing beforehand the number of fuses necessary to allow the data (number N) representing the correction factor of the division ratio of the frequency divider circuit to be encoded in accordance with the foregoing description.

This preparation phase further consists in mounting the various electronic components on the module, i.e. in particular the quartz and the integrated circuit without applying the protective resin onto the integrated circuit (<<potting>>).

Following this preliminary phase, the module is ready to undergo the actual adjustment operation.

The adjustment phase thus consists in measuring the rate of the horological module by means of external apparatus, i.e. measuring the drift between the quartz oscillator frequency and the standard oscillator frequency as was described hereinbefore.

In order not to disturb the features of the integrated circuit, this measurement is preferably performed in well determined lighting conditions.

From this frequency drift, a correction factor is calculated. It will be recalled that this correction factor is determined by the calculation of a number N corresponding, in the case of an inhibition technique, to the number of pulses to be omitted during one determined period $T_h$.

It will also be mentioned that when the correction factor is calculated, account will be taken of the various environmental influences, in particular the lighting conditions, and the subsequent deposition of the protective resin. This influence can be estimated by way of experiment, by a series of preliminary tests allowing an offset value to be determined. This offset value is then considered when the correction factor is calculated.

The following step consists in storing the data (number N) representing the calculated correction factor. For this purpose, the horological module is aligned under a laser device. In particular, care will be taken to align the laser device essentially with respect to a zone of the integrated circuit including the fuses able to be destroyed by laser.

Once this alignment operation has been performed, the laser device is set in action to selectively destroy the fuses necessary for encoding the data (number N) representing the correction factor.

Once the encoding operation has been performed, the protective resin can then be deposited on the integrated circuit.

Subsequent steps to this adjustment phase, including in particular a final test step of the rate of the horological module may then be performed.

The method for adjusting the rate of an horological module according to the present invention thus proves particularly suitable for the mass production and automation of such an operation. It will be noted that, the adjustment method according to the present invention thus allows the manufacturing method to be greatly simplified and a substantial gain to be obtained in terms of manufacturing costs.

It will be understood that numerous modifications can be made to the method for adjusting the rate of the horological module without departing from the scope of the present invention. This invention is thus not only limited to the adjustment of the rate of a horological module via the inhibition technique but also applies by analogy to the pulse adding adjustment technique.

What is claimed is:

1. A method for adjusting the rate of a horological module, said horological module including a printed circuit on which are mounted in particular a quartz and an integrated circuit including:

an oscillator driven by said quartz, a frequency divider circuit, an adjustment circuit allowing a correction factor of the rate of said horological module to be introduced into said frequency divider circuit, and a memory circuit containing data representing said correction factor, this method including the following steps:

a) measuring the rate of said horological module;

b) calculating said correction factor of the rate of said horological module; and c) storing said data representing said correction factor in said memory circuit, wherein the memory circuit includes memory elements formed of fuses which can be destroyed by laser and wherein said integrated circuit is mounted beforehand, prior to measuring step a), on said printed circuit without application of any protective resin, storage step c) including the following steps:

c1) aligning the module under a laser device;

c2) destroying, by means of said laser device, said fuses necessary for coding said data representing the correction factor of the rate of the horological module;

this storage step c) being further followed by the following step:

d) depositing said protective resin over said integrated circuit.

2. The method for adjusting the rate of a horological module according to claim 1, wherein said correction factor calculated at step b) further takes into account an offset value generated by the subsequent deposition of said protective resin at step d).

3. The method for adjusting the rate of a horological module according to claim 1, wherein the method is performed in determined lighting conditions so that the measurement of the rate of said horological module at step a) is not disturbed.

4. The method for adjusting the rate of a horological module according to claim 2, wherein the method is performed in determined lighting conditions so that the measurement of the rate of said horological module at step a) is not disturbed.

* * * * *